358-84 SR
3/3/87 OR 4,647,964

United States Patent [19]

Weinblatt

[11] Patent Number: 4,647,964

[45] Date of Patent: Mar. 3, 1987

[54] TECHNIQUE FOR TESTING TELEVISION COMMERCIALS

[76] Inventor: Lee S. Weinblatt, 797 Winthrop Rd., Teaneck, N.J. 07666

[21] Appl. No.: 791,099

[22] Filed: Oct. 24, 1985

Related U.S. Application Data

[63] Continuation-in-part of Ser. No. 645,428, Aug. 29, 1984, abandoned.

[51] Int. Cl.[4] ..... H04H 9/00

[52] U.S. Cl. ..... 358/84; 455/2

[58] Field of Search ..... 179/2 AS; 358/84; 455/2; 346/37

[56] References Cited

U.S. PATENT DOCUMENTS

| | | | |
|---|---|---|---|
| 3,255,536 | 1/1966 | Livingston | 346/37 |
| 3,328,803 | 6/1967 | Schwerin | 358/84 X |
| 4,052,798 | 10/1977 | Tomita et al. | 35/9 A |
| 4,264,925 | 4/1981 | Freeman et al. | 358/86 |
| 4,308,554 | 12/1981 | Percy et al. | 358/84 |
| 4,331,973 | 5/1982 | Eskin et al. | 358/84 |
| 4,361,851 | 11/1982 | Asip et al. | 358/84 |
| 4,384,284 | 5/1983 | Juso et al. | 340/706 |
| 4,546,382 | 10/1985 | McKenna et al. | 358/84 |
| 4,566,030 | 1/1986 | Nickerson et al. | 358/84 |

*Primary Examiner*—Keith E. George
*Attorney, Agent, or Firm*—Thomas Langer

[57] ABSTRACT

A technique is disclosed for testing the effectiveness of a television commercial before it is broadcast. The commercial is displayed to a test subject in a realistic setting which includes a choice of programs from which he can select. The reactions of the test subject in selecting from among the various programs and commercials available to him are monitored and analyzed.

26 Claims, 2 Drawing Figures

TECHNIQUE FOR TESTING TELEVISION COMMERCIALS

CROSS-REFERENCES TO RELATED APPLICATIONS

This application is a continuation-in-part of Ser. No. 645,428 filed Aug. 29, 1984, now abandoned.

BACKGROUND OF THE INVENTION

This invention is directed to a technique for testing the effectiveness of advertisements and, more particularly, to determine the likelihood that the viewer of a television commercial will turn away from the commercial to programming on another channel.

Placing advertisements on commercial television is expensive. It is, therefore, very helpful to an advertiser before he commits a commercial for broadcast to have an indication of its impact on viewers. The impact of a commercial can be tested, for example, in the following two ways. Firstly, the level of interest in the commercial by the viewer can be measured by the extent to which he switches away from it to programming on other channels. If the viewer fails to stay on the channel showing the commercial then obviously it has failed to hold the viewer's interest and the advertiser's money may be wasted. Secondly, even if the viewer watches all or part of the commercial, he must remember the information which the advertiser is eager to convey like, for example, the product and brand name.

An important aspect of the testing process for a commercial before it is broadcast commercially is to display it under relaxed conditions in a natural environment. The environment must have no abnormal distractions to distort the test results. However, the normal distractions to which the viewer is exposed must be provided. For example, program alternatives to the commercial must be made available if such alternatives normally exist. This prevents unusual concentration on the commercial by the test subject so that distorted results due to artificially created interest are avoided. What is normal or abnormal distraction can be defined in terms of the viewer's home since that is his most natural environment. The standard surroundings are not distracting yet the option of viewing programs on other channels reflects reality. As desirable as such an environment is, it is not practical to take testing equipment door-to-door. Thus, the only practical way to do it now is to actually broadcast the commercial and then telephone test subjects with a list of questions to check their recall. Unfortunately, this incurs the significant expense of broadcasting the commercial and the concomitant loss of confidentiality which the advertiser would prefer to avoid at the test stage.

It is desirable to measure several other aspects indicative of the effectiveness of a commercial. For example, commercials are typically broadcast in groups, or clusters. The order of placement of a commercial within a group may have a bearing on its effectiveness. Also, the number of times a commercial is seen may have a positive, or under certain conditions even a negative, effect on retention. In addition, a commercial may encounter "wear-out" when, after it is seen more than a certain number of times, viewers become tired of it and it loses any effectiveness it may have previously had.

SUMMARY OF THE INVENTION

It is a general object of the invention to provide information regarding the impact of a television commercial on the viewing audience before it is broadcast commercially.

Another object of the invention is to test commercials in a natural environment and thereby obtain realistic test results.

Yet another object of the invention is to provide the test subject with a choice of programming other than the test commercial.

A further object of the invention is to determine the effect of placing the test commercial in a group of commercials.

Still another object of the invention is to obtain an indication of when the commercial has been overexposed in being shown too many times so that viewer interest is diminished.

These and other objects of the invention are attained in accordance with one aspect of the invention by a method for testing a television commercial by monitoring the reactions of a test subject who is viewing said commercial, comprising the steps of providing a plurality of recorded programs with any one being selectable for display at any time at the choice of said test subject, each program including a commercial portion and a non-commercial portion; placing the test commercial into said recorded commercial portion; arranging the test commercial on one recorded program so that it is available for display at times when only a non-commercial portion is available for display on another recorded program; and monitoring the programming selected by said test subject.

Another aspect of the invention is directed to a method for testing a television commercial by monitoring the reactions of a test subject who is viewing the commercial, comprising the steps of providing a plurality of recorded programs with any one being selectable for display at any time at the choice of said test subject; recording as part of each of said programs a commercial portion which includes a test commercial and a filler commercial; arranging said test commercial and said filler commercial in a given sequence for one group of test subjects and in a different sequence for another group of test subjects; and monitoring the programming selected by said test subject.

A further aspect of the invention is directed to a method for testing a television commercial by monitoring the reactions of a test subject who is viewing said commercial, comprising the steps of providing a plurality of recorded programs with any one being selectable for display at any time at the choice of said test subject, each program including a non-commercial portion, a first commercial portion, and a second commercial portion; placing the test commercial into said first and second commercial porions; arranging the first commercial portions on each of said recorded programs so that only one is displayable at any given time; arranging the second commercial portions so that the test commercial therein are all displayable substantially simultaneously; and monitoring the programming selected by said test subject.

Yet another aspect of the invention is directed to apparatus for testing a television commercial by monitoring the reactions of a test subject who is viewing said commercial, comprising a television monitor; a storage medium on which are recorded a plurality of programs for video display and having its output coupled to said television monitor; means actuatable by said test subject for selectably displaying any one of said stored plurality of programs; and means for monitoring the programming selected by said test subject.

BRIEF DESCRIPTION OF THE DRAWINGS

The invention is directed to a technique for testing television commercials and is explained by the detailed description below in combination with the following drawings.

DETAILED DESCRIPTION OF THE PREFERRED EMBODIMENT

Testing of advertisements prior to broadcast can be done in an office serving as a testing studio. Test subjects are screened for characteristics of particular significance for the specific commercial being tested such as sex, age, use of product, location of residence, etc. If they have the charateristics sought, they are recruited and brought to the studio. Alternatively, the studio can be brought to the test subjects by, for example, suitably modifying a mobile home. In either case, standard furnishings are used to simulate an average room where television might be viewed in the home. This puts the test subject at ease and such an environment is more likely to produce realistic test results.

The just-described environment includes only one visible device which the invention requires be pointed out to the test subject; namely, a remote means to change programs on a video monitor. This can be a standard wire or wireless remote control, for example, or a special switch built for the invention. The remainder of the test apparatus is hidden from view.

Figure 1:
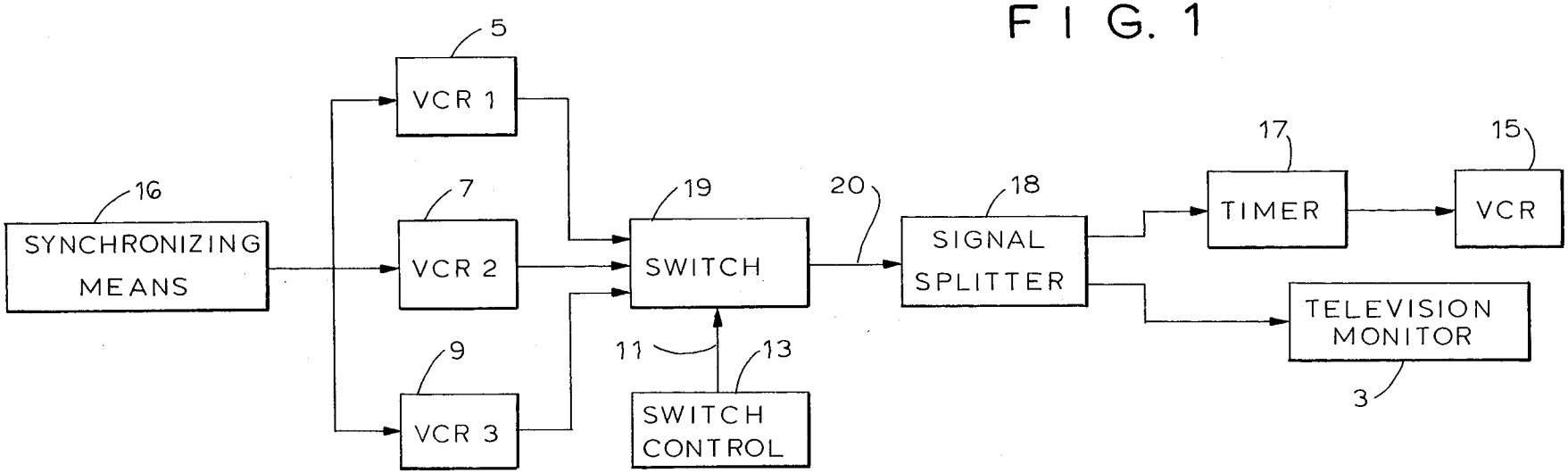
FIG. 1 is a block diagram showing in schematic form an apparatus used to implement the method of the invention.

Turning now to FIG. 1, it shows the apparatus which monitors and records the actions of the test subject. Television monitor ("TV" hereafter) 3 is placed within view of the test subject. Monitor 3 receives its programming signals from three video tape recorders ("VCR" hereafter) 5, 7 and 9 through switch 19. Switch 19 is operated by the test subject and passes to monitor 3 only the program from that VCR selected by suitably actuating the switch. To the test subject it appears that monitor 3 is displaying on-the-air programming and he is simply selecting a program by manipulating switch 19. In fact, as stated above, he is actually selecting prerecorded programs available on the three VCR's. To receive the VCR signals, monitor 3 has its tuner set to a given channel to match the VCR output, as is conventional.

Switch control 11 is provided to actuate switch 19. The test subject has buttons or the like available to him on switch control 11 which he can depress to make a selection. Line 13 connects switch control 11 to switch 19. Line 13 can be an actual wire or it can represent a wireless signal. Model UVA-114S which is mechanical or Model UVA-581S which is electronic are both available from Quasar and can be used for switch 19.

The output signal of switch 19 is provided via signal splitter 18 to monitor 3 as well as to VCR 15 which tapes it to record all the programming selections made by the test subject. When the tape is played back, it displays precisely what the subject viewed and, thus, provides information on the test subject's selection of programming. In order to provide time information relative to the selected programming in a convenient fashion for analysis of the test results, a suitable timer 17 is connected between TV 3 and VCR 15. The output of timer 17 is, therefore, also recorded by the VCR and is displayable along with the programs from TV 3 recorded by it. It is not desirable to display time on monitor 3 because it would be unusual and consequently a distraction to the test subject. Model VTG-88 available from the FOR-A Company Ltd. can be used for the timer.

VCR's 5, 7 and 9 are controlled to operate in synchronism by synchronizing means 16. In the preferred embodiment, only the power, play and stop signals are supplied simultaneously to the three VCR's. The same signal is fed at the same time to all three VCR's so that they all, for example, start tape playback together for a purpose to be explained in detail below. Once started simultaneously, the three VCR's will also run at approximately the same speed to keep the programs playing in synchronism, particularly if the same model of VCR is used for all three. Model HR-3CU available from JVC can be used for the VCR's.

The starting position of each tape is fixed with a "reset" feature available on quality recorders. By depressing a button, the operator records a signal on an internal microchip which counts the number of frames from the desired starting location of the tape. After the tape is recorded or played back, it will rewind and then stop at this preset location where the signal has been recorded. The above-mentioned JVC model includes this feature. It stops the type within four frames of the preset spot. Thus, the VCR's are synchronized as to their starting locations, and with their operating characteristics being substantially the same, the tapes will remain in synchronism during playback. An alternative embodiment is available if greater accuracy is required during playback. A digital synchronizing pulse can be provided to a suitably configured VCR from synchronizing means 16. For example, Model FA-410 available from the FOR-A Company Ltd. is a digital time base corrector which can be used for this purpose. The VCR would, of course, have to include a corresponding sync pulse input.

Figure 2:
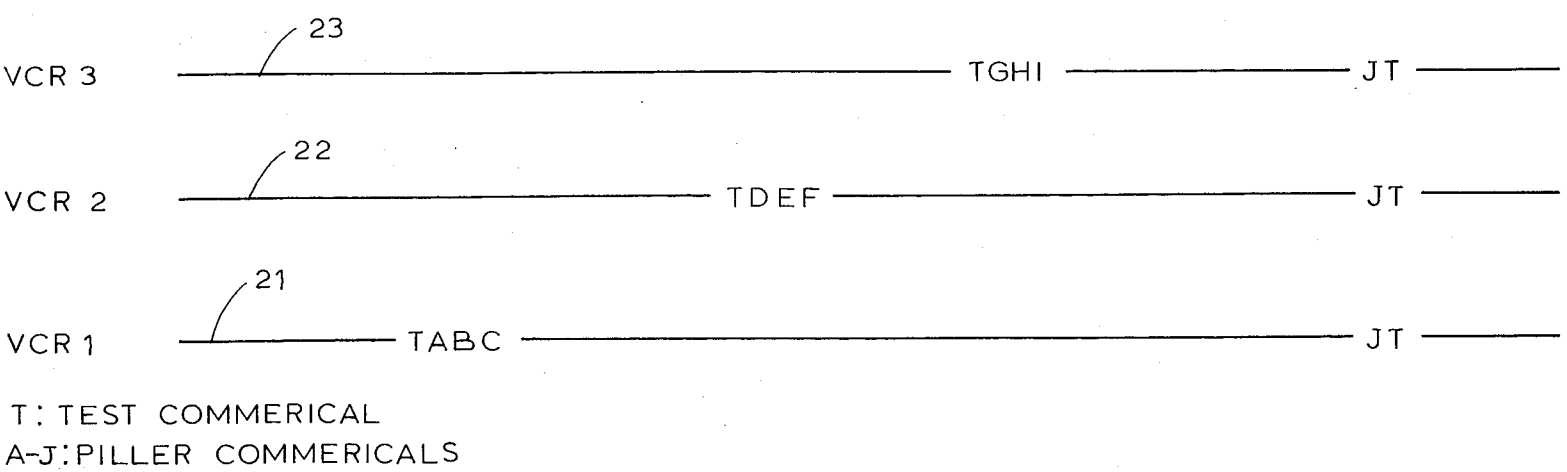
FIG. 2 is a timing chart depicting the programs and commercials as they are made available for viewing to the test subject.

The programs stored on the tapes in each VCR and their relative timing are depicted in FIG. 2. Each has a commercial portion and a non-commercial portion. In the non-commercial portion, each of the recorders shows a different type of program with the three types having been selected as typical of what appears on television in the evenings, for example. Thus, VCR 1 shows a documentary/news program depicted as 21, VCR 2 shows an entertainment program depicted as 22, and VCR 3 shows a situation comedy depicted as 23. The specific programming just described is not as important in and of itself as is the effort to choose realistic, average, typical programming for the locality where the test is being administered.

In the commercial portion of the programming, each VCR shows the test commercial or commercials of interest. Since often commercials are shown in clusters, the test also utilizes a commercial grouping. Each of these groupings includes one test commercial, T, and three filler commercials. The same test commercial is shown by all three VCR's, but different filler commercials are used with each VCR. Again, the commercial groupings and the different filler commercials are used to provide a sense of realism to the test. In the depicted example, VCR 1 shows filler commercials A,B, and C, VCR 2 shows filler commercials D, E, and F, while VCR 3 shows filler commercials G, H, and I. Filler commercial A-I are selected to correspond to the programs in which they appear since certain programs are more likely to show particular commercials.

The positioning of a commercial within a grouping may have an effect on the test subject's level of interest in it. If the commercial appears first he may watch it yet the same commercial when it appears third in the grouping may be tuned out. In order to measure whether the position of the test commercial within a grouping makes any difference, its position is varied as follows. Half of the test subjects are shown the test commercial appearing first in the commercial grouping, as shown in FIG. 2. However, the other half is shown precisely the same programming with the exception that the test commercial is placed third in the grouping. The reactions of the two groups are compared to provide an indication of what difference, if any, can be attributed to this factor.

Each of the three VCR's also includes another recording of the test commercial at a point on the tape following the commercial cluster. The position of this test commercial is placed so that the three VCR's make it available to the test subject simultaneously. Thus, the commercial will appear on TV 3 regardless of which channel is selected by the test subject. This forced exposure ensures that the test subject is exposed to the comercial so that a recall test can be run later.

The preferred way to achieve this forced exposure of the commercial is with a grouping of one filler commercial and one test commercial. The filler, J, precedes the test commercial. Moreover, all three VCR's show the same filler, J. If the test subject is inclined to switch to another channel, the VCR's would have to be precisely synchronized to keep the subject from missing part of the commercial. Attaining the requisite synchronism may not be simple and inexpensive. It can be avoided by ensuring that any channel switching by the subject is completed before the test commercial is shown. This is why the filler commercial precedes the test commercial and why the same one is used on all the VCR's. All the channel switching is likely to be done during the filler because the subject will quickly realize that further switching is fruitless.

The actual test proceeds as follows. A test subject is screened, recruited and brought into the studio. He may or may not be told that the test is about to begin. The preferred technique in order to obtain the most accurate results is to invite him to sit down in what he is told is a waiting room. He is not told that a test is being run but simply that he may watch TV while he is waiting. The remote control is pointed out to him and, if necessary, its operation is explained. Remote control 11 when actuated starts the three VCR's 5, 7, and 9 running simultaneously and in substantial synchronism, turns on TV 3, and also starts VCR 15. The program stored in VCR 5 is shown first and after awhile the commercial grouping TABC appears. The test subject has complete control and, thus, may watch all or part of this grouping or switch at any time to the other channels. His actions are monitored and recorded by VCR 15 for later analysis. Regardless of whether he switches away from the test commercial when it appears, he must see it when it is made available simultaneously on all three VCR's near the end of all three tapes. The programming continues for awhile thereafter to properly set up the necessary conditions for a recall test. After the VCR's have run through their tapes, the system is shut off and the test subject is told what happened. Analysis of the test can proceed by playing back the tape on VCR 15 to determine, for example, how much time the test subject viewed the test commercial, whether he watched it more than once, at what point he switched away, and the difference if any caused by the order in which it was placed in the commercial grouping. He is then requested to answer questions to test his recall and comprehension of what he saw. Also, the reason for his actions can be asked to shed further light on the effect of the commercial.

With the powerful technique of the invention, very valuable information can be gathered at reasonable cost. Before the commercial is broadcast, it can be tested discreetly in selected geographic locations and with a screened group of test subjects if so desired. This enables results to be obtained that are suitably focused on a target audience, within a time frame, and under conditions so as to provide a significant competitive advantage. A single test can (1) measure the value and impact of the components which constitute the test commercial to see whether any should be changed or excised by monitoring the reactions of the test subjects to each of these components, (2) indicate whether position in a commercial grouping makes any difference on viewer impact, (3) note any build-up of retention due to multiple exposure of the commercial to the test subjects by correlating their recall answers to the number of times they viewed the commercial, and (4) when applied to subjects after the commercial has been broadcast for a period of time, it can ascertain commercial "wear-out" if the viewer tunes away from it and if he so indicates this to be his reason during the recall interview.

Although a preferred embodiment of the invention has been disclosed above in detail, a number of changes will be readily apparent. For example, the tuner of monitor 3 and its channel display can be changed by the switch control to correspond to a certain local channel when a particular one of the VCR's is selected by the test subject, instead of being connected to a switch which in turn has its output connected to the TV. Actuation of a button on the switch will tune in signal from the corresponding VCR to the TV. Also, timer 17 need not be connected as shown. Other arrangements are available which allow its output to be synchronized with VCR's 5, 7, and 9 and to have its output displayed on VCR 15. Furthermore, the timing, sequence, and number of commercials in the grouping shown in FIG. 2 can be varied in many ways in accordance with the principles of the invention. In addition, more than three VCR's can be used. Also, the multiple programs can all be stored on a single medium such as a magnetic disk. Yet another such possible change would have only non-commercial programming recorded on VCR's 5, 7, and 9 with all the commercials being recorded on another VCR. The latter would be activated and its output displayed under control of a signal recorded on the tapes in VCR's 5, 7, and 9. This approach adds the flexibility of changing either the commercial or non-commercial programming without affecting the other. A further change would have the simultaneously shown commercial groupings available first with the staggered groupings following them. All these and other such changes are intended to be included within the scope of the invention as defined by the following claims.

I claim:

1. A method for testing a television commercial by monitoring the reactions of a test subject who is viewing said commercial, comprising the steps of providing a plurality of recorded programs with any one being selectable for display at any time at the choice of said test subject, each program including a commercial portion and a non-commercial portion;

making each program available so that its selection by the test subject corresponds to tuning to a particular television channel;

placing the test commercial into the commercial portion of each of said recorded programs;

arranging the test commercial on each one of said plurality of recorded programs so that at least a segment of it is available for display at times when only a non-commercial portion is available for display on all others of said recorded programs;

directly monitoring the programming as the selections are made by said test subject; and determining the point in said recorded programs at which said test subject switches from any one of said plurality of programs to another.

2. The method of claim 1, wherein the recorded commercial portion includes the test commercial and at least one filler commercial.

3. The method of claim 2, further comprising the step of selecting said filler commercial to suit the program within which it appears.

4. The method of claim 3, further comprising the step of for one group of subjects recording the test commercial for display before the filler commercial and reversing such sequence for another group of subjects.

5. The method of claim 4, wherein the step of providing a plurality of recorded programs includes recording such programs on video tape for replay on a video tape recorder ("VCR").

6. The method of claim 5, wherein the plurality of recorded programs are each recorded on an individual tape for replay respectively on a different VCR individually actuatable by said test subject.

7. The method of claim 6 comprising the step of recording for the non-commercial portion typical programs commonly available, with a different such non-commercial portion being used on each of said plurality of recorded programs.

8. The method of claim 7, wherein each of the plurality of recorded programs is provided with another commercial portion which also includes the test commercial, the test commercial of this other commercial portion being displayable substantially simultaneously on all the recorded programs.

9. The method of claim 8, further comprising the step of placing a filler commercial before the test commercial in said other commercial portion.

10. The method of claim 9, further comprising the step of recording the monitored programs selected by the test subject.

11. The method of claim 10, wherein said determining step comprises the step of recording the output of a timer together with the program selected by the test subject.

12. The method of claim 1, further comprising the step of for one group of test subjects recording the test commercial for display before the filler commercial and reversing such sequence for another group of test subjects.

13. The method of claim 1, wherein each of the plurality of recorded programs is provided with another commercial portion which also includes the test commercial, the test commercial of this other commercial portion being displayable substantially simultaneously on all the recorded programs.

14. The method of claim 13, further comprising the step of placing a filler commercial before the test commercial in said other commercial portion.

15. The method of claim 1, further comprising the step of recording the monitored programs selected by the test subject.

16. The method of claim 15, wherein said determining step comprises the step of recording the output of a timer together with the program selected by the test subject.

17. A method for testing a television commercial by monitoring the reactions of a test subject who is viewing the commercial, comprising the steps of providing a plurality of recorded programs with any one being selectable for display at any time at the choice of said test subject;

making each program available so that its selection by the test subject corresponds to tuning to a particular television channel;

recording as part of each of said plurality of recorded programs a commercial portion which includes a test commercial and a filler commercial;

arranging said test commercial and said filler commercial in a given sequence for one group of test subjects and in a different sequence for another group of test subjects;

directly monitoring the programming as the selections are made by said test subject; and determining the point in said recorded programs at which said test subject switches from any one of said plurality of programs to another.

18. The method of claim 17, wherein the test commercial is arranged in the first position in said given sequence and in other than the first position in said other sequence.

19. A method for testing a television commercial by monitoring the reactions of a test subject who is viewing said commercial, comprising the steps of providing a plurality of recorded programs with any one being selectable for display at any time at the choice of said test subject, each program including a non-commercial portion, a first commercial portion, and a second commercial portion;

making each program available so that its selection by the test subject corresponds to tuning to a particular television channel;

Placing the test commercial into the first commercial portion on each of said recorded programs so that the test commercial in only one of said plurality of recorded programs is displayable at any given time;

placing the test commercial into the second commercial portion on each of said recorded programs so that the test commercials on all of said plurality of recorded programs are displayable substantially simultaneously;

directly monitoring the programming as the selections are made by said test subject; and determining the point in said recorded programs at which said test subject switches from any one of said plurality of programs to another.

20. The method of claim 20, wherein the test commercial in the second commercial portion on each of said plurality of recorded programs is placed so that it is available for display only after the test commercial in the first commercial portion on all of the plurality of recorded programs is no longer available for display.

21. Apparatus for testing a television commercial by monitoring the reactions of a test subject who is viewing said commercial, comprising a video display device;

first means coupled to said video display device for providing a program for video display, said program having a commercial portion and a non-commercial portion, said commercial portion including said test commercial;

second means coupled to said video display device for providing at least another program having a commercial portion and a non-commercial portion, said commercial portion including said test commercial;

means to synchronize said first and second providing means so that at least a portion of the test commercial of said first providing means is available for display at a time period which overlaps a time period when the non-commercial portion of said second means is available for display;

selecting means actuatable by said test subject for selectably displaying the program available from the first and second providing means in a manner corresponding to tuning to a particular television channel;

means for directly monitoring the programming selections made by said test subject; and means to enable determination of the point in said recorded programs at which said test subject switches from one of said first and second providing means to the other.

22. The apparatus of claim 21, wherein the determination enabling means comprises a video tape recorder.

23. The apparatus of claim 22, wherein the determination enabling means includes a timer coupled to have its output recorded by said video tape recorder.

24. Apparatus for testing a television commercial by monitoring the reactions of a test subject who is viewing the commercial, comprising means for providing a plurality of programs with any one being selectable for display at any time at the choice of said test subject, each of said recorded programs having a commercial portion which includes a test commercial and a filler commercial;

selecting means for making each program available so that its selection by the test subject corresponds to tuning to a particular television channel;

means for arranging said test commercial and said filler commercial in a given sequence for one group of test subjects and in a different sequence for another group of test subjects;

means for directly monitoring the programming selections made by said test subject; and means to enable determination of the point in said recorded programs at which said test subject switches from any one of said plurality of programs to another.

25. Apparatus for testing a television commercial by monitoring the reactions of a test subject who is viewing said commercial, comprising means for providing a plurality of recorded programs with any one being selectable for display at any time at the choice of said test subject, each program including a non-commercial portion, a first commercial portion, and a second commercial portion said test commercial being included in the first commercial portion and in the second commercial portion in each of said plurality of recorded programs;

means for making each program available so that its selection by the test subject corresponds to tuning to a particular television channel;

means for synchronizing the providing means so that a test commercial from the first commercial portion on only one of said plurality of recorded programs is available for display at a given time, and so that the test commercials from the second commercial portion on all of said plurality of recorded programs are simultaneously available for display at another given time;

means for directly monitoring the programming as the selections are made by said test subject; and means to enable determination of the point in said recorded programs at which said test subject switches from any one of said plurality of programs to another.

26. The apparatus of claim 25, wherein the test commercial in the second commercial portion on each of said plurality of recorded programs is available for display only after the test commercial in the first commercial portion on all of the plurality of recorded programs is no longer available for display.

* * * * *